US005275341A

United States Patent [19]

Romann et al.

[11] Patent Number: 5,275,341

[45] Date of Patent: Jan. 4, 1994

[54] ELECTROMAGNETICALLY OPERATED VALVE

[75] Inventors: Peter Romann, Stuttgart; Ferdinand Reiter, Markgroeningen, both of Fed. Rep. of Germany; Rudolf Babitzka, Savigno, Italy

[73] Assignee: Robert Bosch GmbH, Stuttgart, Fed. Rep. of Germany

[21] Appl. No.: 915,991

[22] PCT Filed: Jan. 21, 1991

[86] PCT No.: PCT/DE91/00050

§ 371 Date: Aug. 3, 1992

§ 102(e) Date: Aug. 3, 1992

[87] PCT Pub. No.: WO91/11611

PCT Pub. Date: Aug. 8, 1991

[30] Foreign Application Priority Data

Feb. 3, 1990 [DE] Fed. Rep. of Germany ..... 4003228

[51] Int. Cl.[5] ..... F02M 51/08

[52] U.S. Cl. ..... 239/585.4

[58] Field of Search ..... 239/585.1-585.5, 533.12, 251/129.15, 129.16, 129.21

[56] References Cited

U.S. PATENT DOCUMENTS

| | | | |
|---|---|---|---|
| 4,509,693 | 4/1985 | Nakai | 239/585.5 |
| 4,700,891 | 10/1987 | Hans et al. | 251/129.21 |
| 4,915,350 | 4/1990 | Babitzka | 251/129.15 |
| 5,002,231 | 3/1991 | Reiter et al. | 239/585.1 |

FOREIGN PATENT DOCUMENTS

| | | | |
|---|---|---|---|
| 2755400 | 6/1979 | Fed. Rep. of Germany | 239/585.2 |
| 241971 | 9/1990 | Japan | 239/585.4 |

*Primary Examiner*—Andres Kashnikow
*Assistant Examiner*—Kevin P. Weldon
*Attorney, Agent, or Firm*—Edwin E. Greigg; Ronald E. Greigg

[57] ABSTRACT

An electromagnetically operable valve having a fuel inlet connecting piece which is surrounded by a magnet coil and is used as a core, at least a part of the valve is surrounded by a plastic sheath on which an electrical connecting plug is integrally formed. In the novel valve, the electrical connecting plug is injection molded at the same time as the extrusion coating of the magnet coil and thus forms an independent plastic injection molding. Only one valve extrusion coating tool is now required for different embodiments of the electrical connecting plug, resulting in greater flexibility in the assembly line. The valve is used as an injection valve for fuel injection systems.

17 Claims, 2 Drawing Sheets

ELECTROMAGNETICALLY OPERATED VALVE

PRIOR ART

The invention is based on an electromagnetically operable valve as set forth hereinafter.

An electromagnetically operable valve has already been proposed in U.S. patent application Ser. No. P 38 25 135.3, U.S. Pat. No. 4,967,666, in which at least a part of the valve is surrounded by a plastic sheath, and on which an electrical connecting plug is integrally formed. However, different valve extrusion coating tools are required depending on the embodiment of the electrical connecting plug. This prevents cost-effective, flexible assembly.

ADVANTAGES OF THE INVENTION

The valve according to the invention has the advantage of simple production and assembly which permits cost-effective mass production since only a single valve extrusion coating tool is required for the different embodiments of the electrical connecting plug. As a consequence, this results in greater flexibility during assembly. Good handling capability of the plastic injection moulding, which consists of the magnet coil and the electrical connecting plug, can be named as a further advantage.

It is particularly advantageous to provide on the circumference of the inlet-side end of the fuel inlet connecting piece an annular groove whose radially extending side surfaces are formed by the plastic sheath surrounding a part of the valve, and whose groove base is formed by the circumference of the fuel inlet connecting piece.

It is also advantageous if an axial gap, in which there is arranged, by clamping-in, a non-magnetic stop plate which forms a residual air gap between the inlet-side end of the armature and the core end and which bounds the movement of the valve closing body during the valve opening process, is formed between the end surface of the core end facing the armature and a shoulder of the intermediate part.

It is likewise advantageous if the fuel inlet connecting piece exhibits a constant external diameter over its entire length.

It is particularly advantageous if the cylindrical valve seating body exhibits a constant external diameter.

A valve having the features set forth herein makes possible a compact, short structural shape of the valve.

DRAWING

An exemplary embodiment of the invention is shown in simplified form in the drawing and is explained in more detail in the following description.

FIG. 1 shows an exemplary embodiment of a valve designed according to the invention, and FIG. 2 shows the independent plastic injection moulding which consists of the magnet coil and the electrical connecting plug.

DESCRIPTION OF THE EXEMPLARY EMBODIMENT

Figure 1:
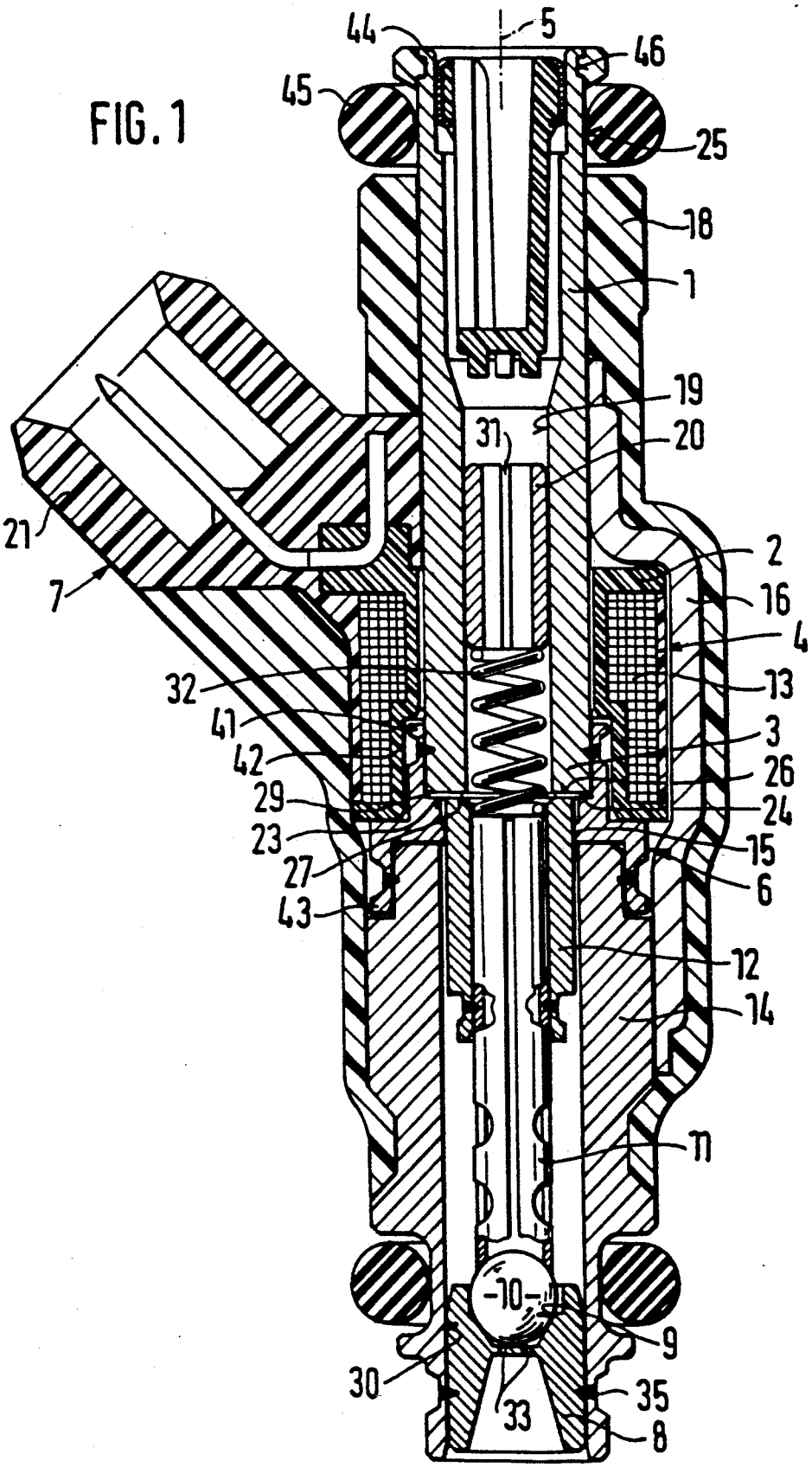
Figure 2:
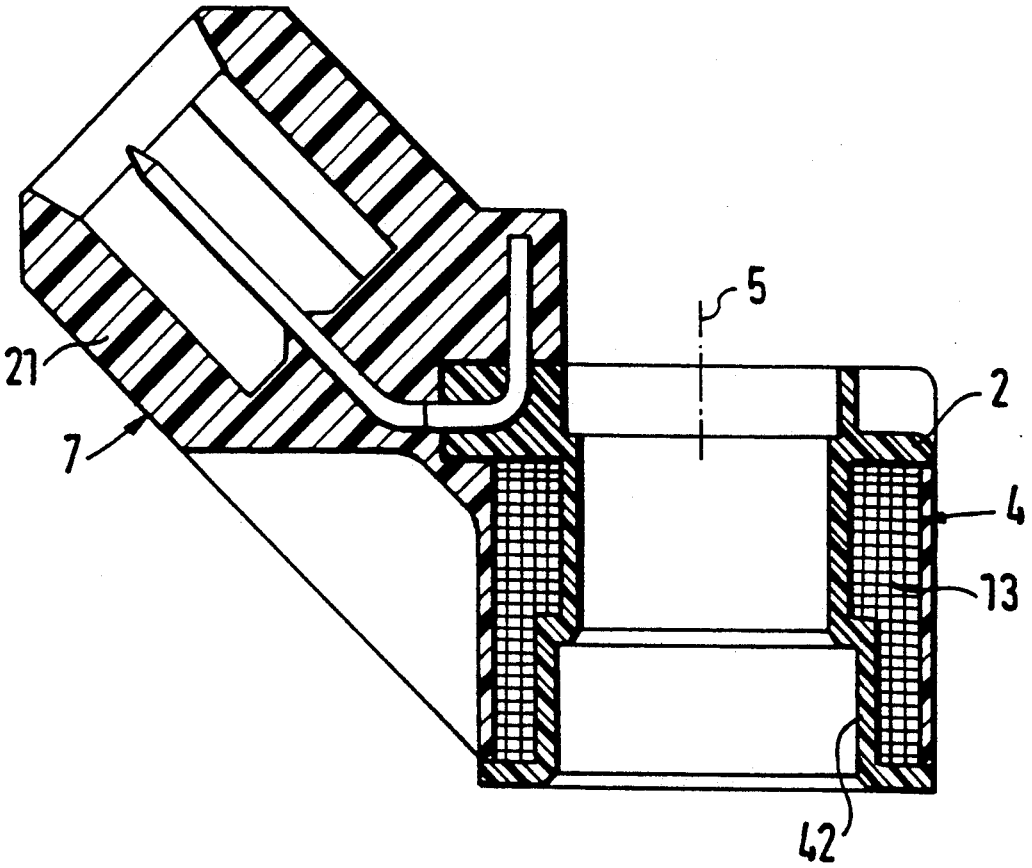

The electromagnetically operable valve, which is shown by way of example in FIG. 1, in the form of an injection valve for fuel injection systems of internal-combustion engines has a fuel inlet connecting piece 1, which is surrounded by a magnet coil 4, is used as a core and exhibits a constant external diameter, constructed for example by means of centreless grinding, over its entire length in order to make use of the space as well as possible. The magnet coil 4, having a coil former 2, is provided, as is shown in FIG. 2, with a plastic extrusion coating 7, an electrical connecting plug 21 being injection moulded at the same time, so that an independent plastic injection moulding is produced which contains the magnet coil 4 and the connecting plug 21. The magnet coil 4, which in the radial direction exhibits a stepped coil former 2 having a winding 13 which is stepped in the radial direction, in conjunction with the fuel inlet connecting piece 1, which exhibits a constant external diameter, makes possible a short and compact construction of the injection valve, as is explained in the following text.

A tubular metallic intermediate part 6 is closely connected to a lower core end 3 of the fuel inlet connecting piece 1, concentrically with respect to a valve longitudinal axis 5, by welding, and at the same time engages partially axially around the core end 3 by means of an upper cylindrical section 41. The stepped coil former 2 engages partially around the fuel inlet connecting piece 1 and, by means of a step 42 having a larger diameter, a cylindrical section 41 of the intermediate part 6. At its end facing away from the fuel inlet connecting piece 1, the intermediate part 6 is provided with a lower cylindrical section 41 which engages around a tubular connecting part 14 and is closely connected thereto by welding. A cylindrical valve seating body 8 is closely mounted into the downstream end of the connecting part 14 by welding. The arrangement in a row of the fuel inlet connecting piece 1, the intermediate part 6, the connecting part 14 and the valve seating body 8 thus represents a rigid metallic unit. The valve seating body 8 exhibits a constant external diameter, constructed for example by means of centreless grinding, so that the valve seating body 8 can be inserted completely into the connecting part 14 and improved sealing between the valve seating body 8 and the internal hole 30 in the connecting part 14 is achieved by means of the longer overlap.

An adjusting sleeve 20, which is pushed into a flow bore 19 in the fuel inlet connecting piece 1, exhibits a slot 31 in the longitudinal direction, and is formed for example out of rolled spring-steel sheet, is used for adjusting the spring pretensioning of a restoring spring 32 which abuts against the adjusting sleeve 20 and is supported downstream on a connecting pipe 11. A tubular armature 12, which is guided by a guide collar 15 of the intermediate part 6, is connected by welding to the end of the connecting pipe 11 facing the restoring spring 32. A valve closing body 10, which interacts with the valve seat 9 of the valve seating body 8 and is constructed for example as a ball, is connected to the connecting pipe 11 by soldering or welding, at the other end of said connecting pipe 11. At least one spray opening 33, formed for example by erosion, is constructed downstream from the valve seat 9 in the valve seating body 8. The welded seam 35 between the valve seating body 8 and the connecting part 14 is at a relatively large distance from the spray opening or openings 33 and from the valve seat 9, so that an effect on the flow quantity and lack of sealing resulting from warping of the valve seating body 8 as a consequence of the high temperatures occurring during welding are effectively prevented.

An axial gap 29 in which there is arranged, by clamping in, a non-magnetic stop plate 27 which forms a residual air gap between the inlet-side end 26 of the armature 12 and the end surface 23 of the core end 3 and which bounds the movement of the valve closing body 10 during the valve opening process, is formed between the end surface 23 of the core end 3 facing the armature 12 and a shoulder 24, which leads to the upper cylinder section 41, of the intermediate part 6. Because of its relatively high bending stiffness, the clamped stop plate 27 protects the end surface 23 of the core end 3 against wear better than a loose plate, in which there is a risk of tilting or of stopping unevenly.

The magnet coil 4 is surrounded by at least one guide element 16 which is constructed as a clip in the exemplary embodiment, is used as a ferromagnetic element, extends over the entire length of the magnet coil 4 in the axial direction, and at least partially surrounds the magnet coil 4 in the circumferential direction, and abuts against the fuel inlet connecting piece 1 at its one end and against the connecting part 14 at its other end, and is connected to said connecting piece 1 and connecting part 14 for example by welding.

A part of the valve is surrounded by a plastic sheath 18 which extends axially, originating from the fuel inlet connecting piece 1, over the magnet coil 4 with the connecting plug 21 and the at least one guide element 16 and, at the same time, forms radially extending side surfaces of an annular groove 25 which is provided on the circumference of the inlet-side end 44 of the fuel inlet connecting piece 1. The groove base of the annular groove 25, which exhibits for example a sealing ring 45, is formed by the circumference of the fuel inlet connecting piece 1. The plastic sheath 18 engages into a retaining groove 46 at the inlet-side end 44 of the fuel inlet connecting piece 1.

The described plastic extrusion coating 7 of the magnet coil 4, in conjunction with the connecting plug 21 which is injection moulded at the same time, permits high flexibility during assembly of valves of different construction, since only one extrusion coating tool is required to produce the plastic sheath 18 for connecting plugs 21 and magnet coils 4 of different design. The magnet coil 4, which exhibits the coil former 2 which is stepped in the radial direction with the winding 13 which is stepped in the radial direction, makes possible a compact and short structural shape of the valve, in that said coil overhangs the upper cylindrical section 41 of the intermediate part 6 and hence produces an agglomeration of the individual parts.

The foregoing relates to a preferred exemplary embodiment of the invention, it being understood that other variants and embodiments thereof are possible within the spirit and scope of the invention, the latter being defined by the appended claims.

We claim:

1. An electromagnetically operable injection valve for fuel injection systems of internal-combustion engines, having a fuel inlet connecting piece which is surrounded by a magnet coil and is used as a core, an armature (12) by means of which a valve closing body (10) which interacts with a stationary valve seat (9) is operated, a tubular metallic intermediate part (6) which is closely connected at a first end of said tubular intermediate part to a second end of the core of the fuel inlet connecting piece facing the armature and a third end of said tubular intermediate part is connected to a tubular connecting part, a metallic valve seating body (8) which exhibits the stationary valve seat (9) and is attached to the connecting part at a fourth end of said connecting part facing away from the intermediate part, at least one guide element which is constructed as a clip, said clip is used as a ferromagnetic element, extends over an entire length of the magnet coil in the axial direction and at least partially surrounds the magnet coil in a circumferential direction, a plastic sheath (18) which surrounds at least a part of the valve and an electrical connecting plug (21), a plastic extrusion coating (7) surrounds the magnet coil (4) and at the same time forms said electrical connecting plug (21) so that the magnet coil (4) is assembled together with the connecting plug (21) within an independent plastic injection moulding which is surrounded supplementary by said plastic sheath (18).

2. A valve according to claim 1, in which an annular groove (25) includes radially extending side surfaces formed by the plastic sheath (18) surrounding a part of the valve and an annular groove base is formed by a circumference of the fuel inlet connecting piece (1), the annular groove is provided on the circumference of the inlet-side end (44) of the fuel inlet connecting piece (1).

3. A valve according to clam 1, in which an axial gap (29), in which there is arranged, by clamping-in, a non-magnetic stop plate (27) which forms a residual air gap between an inlet-side end (26) of the armature (12) and the second end (3) of the core and which bounds a movement of the valve closing body (10) during a valve opening process, is formed between an end surface (23) of the second end (3) of the core facing the armature (12) and a shoulder (4) of the intermediate part (6).

4. A valve according to claim 2, in which an axial gap (29), in which there is arranged, by clamping-in, a non-magnetic stop plate (27) which forms a residual air gap between an inlet-side end (26) of the armature (12) and the second end (3) of the core and which bounds a movement of the valve closing body (10) during a valve opening process, is formed between an end surface of the second end (3) of the core facing the armature (12) and a shoulder (4) of the intermediate part (6).

5. A valve according to claim 1, in which the fuel inlet connecting piece (1) exhibits a constant external diameter over its entire length.

6. A valve according to claim 2 in which the fuel inlet connecting piece (1) exhibits a constant external diameter over its entire length.

7. A valve according to claim 3, in which the fuel inlet connecting piece (1) exhibits a constant external diameter over its entire length.

8. A valve according to claim 4, in which the fuel inlet connecting piece (1) exhibits a constant external diameter over is entire length.

9. A valve according to claim 1, in which the valve seating body (8) exhibits a constant external diameter.

10. A valve according to claim 2, in which the valve seating body (8) exhibits a constant external diameter.

11. A valve according to claim 3, in which the valve seating body (8) exhibits a constant external diameter.

12. A valve according to claim 4, in which the valve seating body (8) exhibits a constant external diameter.

13. A valve according to claim 5, in which the valve seating body (8) exhibits a constant external diameter.

14. A valve according to claim 6, in which the valve seating body (8) exhibits a constant external diameter.

15. A valve according to claim 7, in which the valve seating body (8) exhibits a constant external diameter.

16. A valve according to claim 8, in which the valve seating body (8) exhibits a constant external diameter.

17. An electromagnetically operable injection valve for fuel injection system of internal-combustion engines according to claim 1, in which said, fuel inlet connecting piece is surrounded by a magnet coil and is constructed as a core, in which the magnet coil (4) exhibits a coil former (2) which is stepped in a radial direction and has a winding (13) which is stepped in a radial direction.

* * * * *